United States Patent [19]

Paige et al.

[11] 4,007,456

[45] Feb. 8, 1977

[54] GAS DETECTING AND WARNING SYSTEM

[75] Inventors: Roy C. Paige, Ravena; Jonathan B. Wright, Schenectady, both of N.Y.

[73] Assignee: Craftor Inc., Albany, N.Y.

[22] Filed: Dec. 1, 1975

[21] Appl. No.: 636,537

[52] U.S. Cl. ..... 340/237 R; 23/255 E; 340/248 B; 340/409

[51] Int. Cl.[2] ..... G08B 17/10; G08B 19/00

[58] Field of Search ..... 340/237 R, 409, 248 B; 73/23, 27 R; 23/232 E, 254 E, 255 E

[56] References Cited

UNITED STATES PATENTS

| | | | |
|---|---|---|---|
| 3,733,595 | 5/1973 | Benedict | 340/237 R |
| 3,750,123 | 7/1973 | Caillouet, Jr. | 340/237 R |
| 3,801,972 | 4/1974 | Ho Kim et al. | 340/237 R |
| 3,826,180 | 7/1974 | Hayashi | 340/237 S X |
| 3,860,919 | 1/1975 | Aker | 340/237 R |
| 3,864,628 | 2/1975 | Klass et al. | 73/23 X |
| 3,879,717 | 4/1975 | Gruensfelder | 340/237 R |
| 3,882,478 | 5/1975 | Skarman | 340/237 R |
| 3,895,367 | 7/1975 | Visser et al. | 340/237 R |
| 3,906,473 | 9/1975 | Le Vine | 340/237 R |
| 3,909,816 | 9/1975 | Teeters | 340/237 R |

*Primary Examiner*—John W. Caldwell
*Assistant Examiner*—Daniel Myer
*Attorney, Agent, or Firm*—Joseph V. Claeys

[57] ABSTRACT

A new and improved gas detecting and warning system of the type employing a metal oxide semiconductor gas detector device and which incorporates a quad comparator integrated circuit means having four independent comparator sections. One of the sections is arranged with the gas detector device to provide a digital limit detector operative to produce an output and a warning alarm whenever the voltage developed across a load resistance in series with the gas detector device exceeds a predetermined value. Another comparator section is arranged with an R-C timing circuit to inhibit operation of the warning alarm for a predetermined time after system energization to prevent false alarms during the initial warm up of the gas detector device. The other two comparator sections are arranged to cause intermittent energization of the warning alarm if there is a failure or malfunction of the gas detector device and/or a failure of its associated components.

19 Claims, 3 Drawing Figures

GAS DETECTING AND WARNING SYSTEM

BACKGROUND OF THE INVENTION

The present invention relates to gas detecting and warning systems of the type employing a metal oxide gas sensor device. More particularly, the invention relates to a new and improved gas detecting and warning system of such type which incorporates a monolitic quad comparator integrated circuit means to provide a system which is extremely stable and reliable in operation, produces a distinctive failure indication and warning upon failure of the gas sensor device and/or associated circuitry to function, and one which is easier and less expensive to manufacture and calibrate.

Metal oxide gas sensor devices are commercially available and have been employed in various prior types of gas detecting and warning systems, such as for example, those systems shown and described in the following U.S. Pat. Nos.:

3,631,436—Taguchi;
3,733,595—Benedict;
3,860,919—Aker;
3,895,367—Visser.

Gas sensor devices of the metal oxide type must be heated to a predetermined temperature since the resistance between the electrodes is very small when the semiconductor sensing element is at room temperature and gradually increases to a very high value. After a predetermined period, usually in the range of one to three minutes or so, the device attains a stabilized condition at which it exhibits maximum sensitivity. When the device is then exposed to a contaminating gas, such as carbon monoxide, hydrogen, hydrocarbons, or the like, the resistance between the electrodes is significantly reduced and the current flow through the device is considerably increased. Many prior art systems have utilized this change in current flow directly to control the operation of active devices such as transistors. Such arrangements, although convenient, leave much to be desired since the operating characteristic tolerances vary over a broad range which creates difficulty both from the standpoint of reliability of operation of the system, as well as, from the standpoint of manufacture and calibration.

Further, since during the foregoing stabilizing heating period the system is prone to produce false warnings, it is desirable that the warning alarm means be inhibited for a predetermined period of time after the system has been energized.

Also, since such systems are relied upon to always be ready to function when necessary and produce a warning in the presence of the contaminating gas, it is desirable that the system be fail-safe and provide an indication upon the failure of the gas sensor device to function. All of the foregoing are provided in the gas detecting and warning system of the present invention and in a very simple, inexpensive and reliable manner.

Accordingly, it is an object of this invention to provide a new and improved gas detecting and warning system employing a gas detector device of the metal oxide type which substantially overcomes one or more of the prior art difficulties and in an arrangement which is less complex, less expensive to manufacture and more reliable than any other known prior art system.

It is another object of this invention to provide a new and improved gas detecting and warning system employing a gas detector of the metal oxide type and which employs a monolithic quad comparator integrated circuit means in a novel arrangement to achieve stable and reliable comparison between a "safe" and an "unsafe" ambient condition, stable and reliable time delay, simple sesitivity adjustment, and a "fail safe" failure detection and warning.

It is a further object of the invention to provide a gas detecting and warning system employing a gas detector of the metal oxide type which can be operated from an A-C or D-C power source as well as from an A-C power source with D-C stand-by power.

BRIEF SUMMARY OF THE INVENTION

Briefly stated, in accordance with one aspect of the invention, the gas detecting and warning system employs a metal oxide semiconductor gas sensor device and a load resistance means connected in series circuit relationship with a suitable voltage source to produce current flow therethrough. The system also includes a monolithic quad comparator integrated circuit means having four independent comparator sections. Two of the comparator sections are arranged with the gas sensor device, the load resistance means, and a time delay circuit to inhibit operation of the warning alarm means during the time the gas sensor is being heated to its stabilizing temperature. The other two comparator sections are arranged together in a fail-safe failure detecting circuit to provide for intermittent operation of the warning alarm when the voltage developed across the load resistance means is less than a predetermined value indicating that there is a failure of the gas sensor device and/or a failure of the associated circuitry. Since the warning alarm operates in a continuous mode to indicate and warn of the presence of a contaminating gas in the ambient air, the intermittent operating mode of such warning alarm provides a distinctive indication of failure.

GENERAL DESCRIPTION

Figure 1:
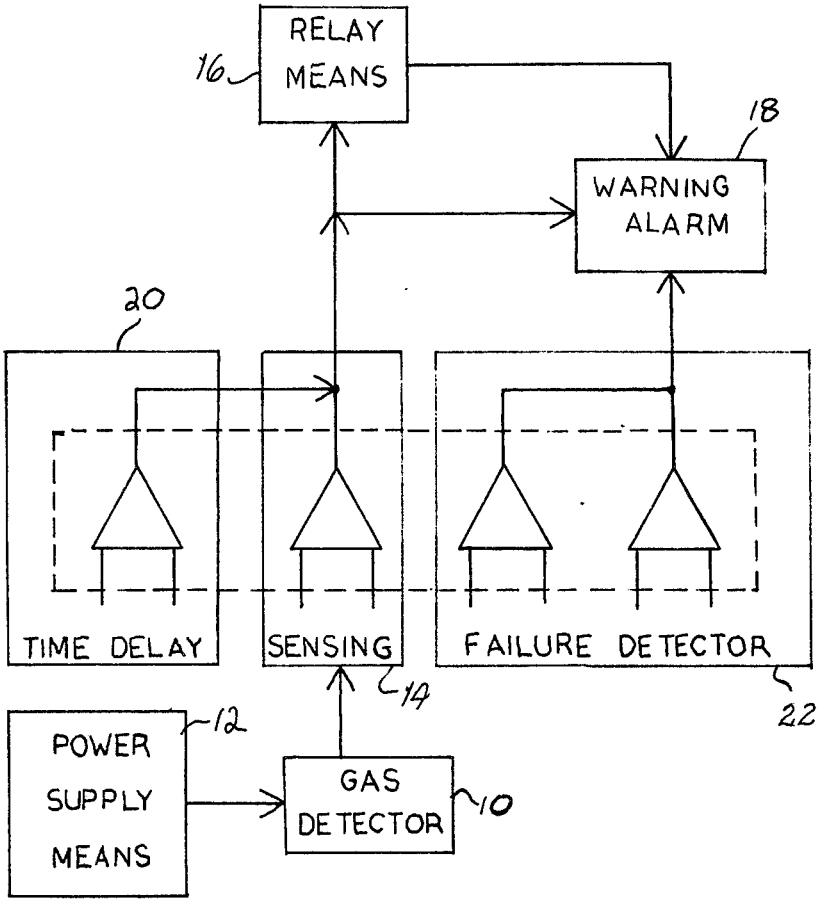
FIG. 1 is a block diagram representing the basic system combination of one embodiment of the invention.

FIG. 1 illustrates in general block diagram form the basic system combination of the gas detecting and warning system of the invention. As shown, the system comprises a gas detector 10 connected with a suitable power supply means 12 operative to produce the power to heat the gas detector to a predetermined temperature and also to produce a flow of current through the detector. The system also includes a quad comparator integrated circuit means, shown as the broken line block, having four independent comparator sections. One of the comparator sections is included in a sensing circuit means 14 arranged with the gas detector 10 to cause energization of a suitable visual or audible warning alarm means 18 when a contaminating gas is present in the ambient environment of gas detector 10. As illustrated, the alarm means may be arranged to be energized by a relay means 16, if desired. The system is also provided with a time delay means 20 including another comparator section and which is arranged to inhibit the operation of the warning alarm 18 for a predetermined period to prevent false warnings during the time the gas detector 10 is being heated to its predetermined stablizing temperature. There is also provided in the system of this invention a fail-safe failure detecting means 22 including the other two comparator sections and arranged to cause a distinctive warning mode of operation of the alarm means 18 when the gas detector 10 fails or is inoperative for any reason such as, for example, a broken wire, loss of heater excitation, or the like. Specifically, the fail-safe detector 22 is operative to provide for a distinctive intermittent activation of the warning alarm 18 when any such circuit or gas detector failure has been detected. Since the warning for the presence of a contaminating gas is a continuous activation of the alarm means 18, the intermittent operation thereof provides a very distinctive indication of a failure.

DETAILED DESCRIPTION

Figure 2:
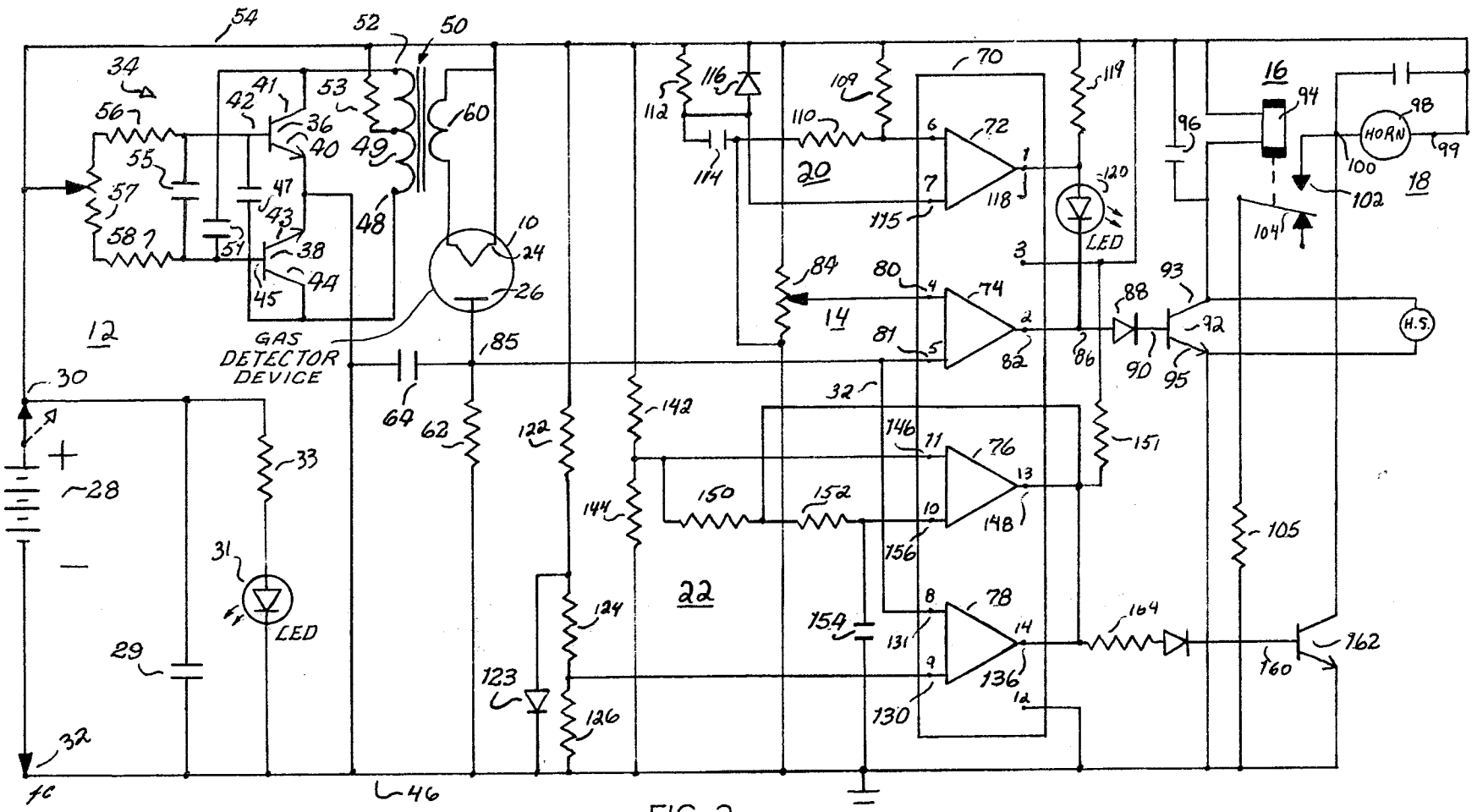
FIG. 2 is a schematic circuit diagram of a gas detecting and warning system in accordance with an embodiment of the invention arranged for operation with a direct current power source.

In FIG. 2 there is illustrated a schematic circuit diagram of an embodiment of the invention arranged for operation from a direct current supply. The gas detecting and warning system employs a gas detector 10 of the metal oxide semiconductor type. Metal oxide gas detector devices are now well known and are commerically available. Such devices must be heated to a predetermined temperature in order to increase their sensitivity. The gas detector devices, therefore, include a body of semiconductive material incorporating two electrodes, one of which is arranged to serve as a filament to provide for the required heating of the device. Gas detector device 10 is thus shown in FIG. 2 as having two spaced electrodes 24 and 26; electrode 24 being illustrated as the filament electrode.

Figure 3:
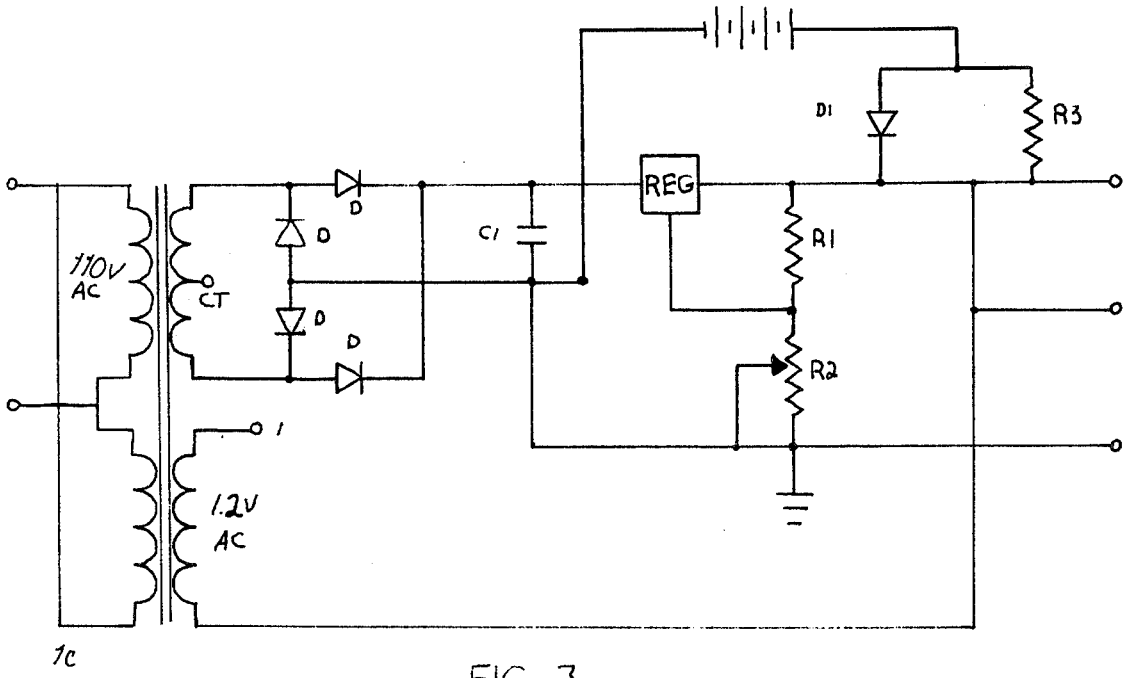
FIG. 3 is a schematic circuit diagram of a regulated power supply means especially suitable for use with this invention.

When the system is operated from a direct current source the power supply means 12 includes the direct current source which provides the means to produce current flow in the gas detector device 10 and an oscillator means to provide an alternating current voltage of 1.2 volts to provide the heater power for the device 10. When intended to be operated from an A-C source a suitable power supply means would provide for both the low voltage filament heating power and the direct current power for the system. A suitable regulated power supply adapted for use with the system to provide for operation with A-C as well as D-C stand-by, is shown in FIG. 3. The alternating current is applied to the primary winding of a transformer and power for the filament electrode of the gas detector is available from one secondary winding of the transformer. Power for the system and for producing current flow through the gas detector is available from a full-wave rectifier means which is connected across another secondary winding of the transformer. The particular organization and arrangement of the power supply shown in FIG. 3 forms no part of the present invention and no further description is deemed necessary to a full understanding of the invention.

Referring again to FIG. 2, there is shown a direct current source, shown as 12-volt battery 28, connected with the system terminals 30 and 32. The terminal 32 is also shown as being connected with a point of reference potential, such as ground. As is conventional, a filter capacitance 29 is also connected across terminals 30 and 32. An indicator, shown as a light emitting diode 31, is connected through a current limiting resistance 33 across terminals 30 and 32 to provide a visual indication that the system is energized.

As stated previously, the filament electrode 24 provides the means of heating the device to the required temperature. Filament electrode 24 is energized with an alternating current of 1.2 volts. To provide this alternating current voltage for electrode 24 when the system is to be operated from a direct current supply (or for normal operation from an alternating current supply with provision for stand-by battery operation), the system is provided with a suitable oscillator means 34. Although any suitable oscillator may be employed, a high frequency oscillator is preferred. For example, in the arrangement shown in FIG. 2 the oscillator 34 is a 50 khz sine wave oscillator. A high frequency oscillator is preferred to avoid the possibility of sounds therefrom which could be particularly distrubing for gas detecting and warning systems used in homes and other structures occupied by people.

Oscillator 34 includes a pair of transistor devices 36 and 38. Transistor device 36 has an emitter electrode 40, a collector electrode 41 and base electrode 42. Similarly, transistor device 38 has an emitter electrode 43, a collector electrode 44 and a base electrode 45. Emitter electrodes 40 and 43 are connected together and to the reference supply line 46. Collector electrode 44 is coupled through a capacitance 47 to base electrode 42 and is also connected to one terminal 48 of the primary winding 49 of a step-down 50 khz ferrite core transformer 50. Similarly, collector electrode 41 is coupled to base electrode 45 through a capacitance 51 and is also connected to the other terminal 52 of primary winding 49. The mid-point of primary winding 49 is connected through a resistance 53 to the other supply line 54. A capacitance 55 is connected across base electrodes 42 and 45 which are in turn connected together through resistances 56, 57 and 58. The secondary winding 60 of transformer 50 is connected with filament electrode 24 of gas detector 10.

In operation, as capacitance 51 charges up, it provides a turn-on voltage for transistor device 38. With transistor 38 conducting, capacitance 51 discharges providing one half of the sine wave at transformer 50. Also, with transistor 38 conducting, capacitance 47 charges up which provides a turn-on voltage for transistor 36 which then provides the other half of the sine wave to transformer 50, discharges capacitance 47 and charges up capacitance 51. This process continues and a 50 khz output of 1.2 volts is produced across the secondary winding 60, which output is applied to the filament electrode 24 of gas detector device 10 to provide the required heater power.

As shown, filament electrode 24 is also connected with the supply line 54. The other electrode 26 is connected through a load resistance 62 to the other supply line 46. A filter capacitance 64 is connected across load resistance 62. The battery supply voltage across supply lines 46 and 54 is thus applied across electrodes 24 and 26 and produces a flow of current through the device 10 and load resistance 62.

In the presence of a contaminating gas the resistance of gas detector device 10 is lowered causing an increase in the current flow through the device 10 and through load resistance 62 and an increased voltage drop across such load resistance.

In accordance with this invention the gas detecting and warning system employs a monolithic quad comparator integrated circuit 70 having four independent comparator sections 72, 74, 76 and 78. One section is utilized with the sensing circuit means 14, another section is utilized with the time delay means 20 and the remaining two sections are utilized with the fail-safe failure detecting circuit means 22. A monolithic quad comparator which has been employed successfully in the system of the present invention is one manufactured and sold by Motorola Semiconductor Products, Inc. designated as No. MC3302P, "Monolithic Quad Single-Supply Comparator."

As shown in FIG. 2, comparator section 74 has input terminals 80 and 81 and an output terminal 82. A reference voltage is applied to input terminal 80 by means of variable resistance 84. Input terminal 81 is connected with the junction point 85 which thus applies the voltage developed across load resistance 62 to the input terminal 81. Comparator section 74 thus acts digitally as a limit detector and produces an output at the output terminal 82 whenever the voltage developed across load resistance 62 equals or exceeds the reference voltage applied to the input terminal 80. When an output is also present at the junction point 86 from the time delay circuit 20, sufficient current flows through a diode device 88 into the base electrode 90 of a transistor switch 92 to render such transistor conductive. In the arrangement shown transistor 92 has its collector electrode 93 connected through the coil of a relay 94 to the supply line 54 and its emitter electrode 95 to the other supply line 46. Accordingly, relay 94 is caused to be energized when transistor 92 is conductive. A capacitance 96 is connected across the relay to filter voltage surges on the relay contacts.

An alarm means, shown as a horn 98 has one terminal 99 thereof connected with the supply line 54 and the other terminal 100 connected with a contact 102 or relay 94. The movable contact 104 is adapted, when relay 94 is energized, to connect relay contact 102 with the supply line 46 through a suitable current limiting resistance 105. Accordingly, when transistor 92 is rendered conductive relay 94 is energized which brings movable contact 104 into contact with relay contact 102 thereby causing horn 98 to be energized from the 12-volt supply lines 54–46 to produce a continuous audible alarm. It will be understood by those skilled in the art that the relay 94 may be omitted and the alarm energized through the emitter-collector circuit of transistor 92 if desired.

A conventional heat responsive switch H.S. is connected across the emitter - collector electrodes of transistor 92. Closure of the heat responsive switch H.S. due to an elevated ambient temperature causes operation of the horn 98.

When the voltage developed across load resistance 62 becomes less than the reference voltage applied to input terminal 80 of the comparator section 74, there will no longer be an output from that comparator section and transistor 92 and the alarm will turn off. In the arrangement illustrated in FIG. 2, when transistor 92 turns off relay 94 is no longer energized and contacts 102–104 open with the result that horn 98 ceases to be activated thereby returning the alarm means to the normal state.

To provide the required warm up time for the gas detector 10 and prevent false alarms, comparator section 72 is utilized with an R-C timing network to inhibit activation of the alarm means for a predetermined time after the system is energized. To this end, input terminal 108 of comparator section 72 is provided with a reference voltage by means of a resistance bridge including resistances 109 and 110. An R-C timing network, including the series combination of a resistance 112 and capacitance 114, applies a delay voltage on the other input terminal 115 of comparator section 72 a predetermined time after the system is energized. In the particular arrangement illustrated capacitance 114 charges above the reference voltage applied to input terminal 108 in about 3 to 5 minutes. A diode 116 connected as shown is provided to allow capacitance 114 to discharge instantaneously whenever the power is off to assure that the time delay circuit will always be in condition to provide its delay function. When capacitance 114 is so charged an output appears at the output terminal 118 of comparator section 72. The output from output terminal 118 is fed to the junction point 86 at the output of comparator section 74. A resistance 119 is provided to limit the current on output terminals 118 and 82. Until such time as this output from comparator section 72 appears at junction point 86, the output from comparator section 74 is not effective to render transistor 92 conductive. Specifically, until an output is present from comparator section 72 the voltage at point 86 is too low to allow sufficient current flow to turn on transistor 92 even though an output is present at section 74. Accordingly, until the timing circuit has timed out to produce an output from comparator section 72, the alarm means 18 is effectively inhibited and false alarms during the warm-up period are prevented.

A visual indication that the time delay has expired may be conveniently provided by means of a light emitting diode 120 connected from the output terminal 118 of comparator section 72 to the junction point 86 at the output of comparator section 74.

The system also includes a fail-safe failure detector circuit means 22 to provide for a warning signal in the event of a catastrophic failure of the gas sensor device 10, load resistance 62, filter capacitor 28, or other circuitry associated with the gas sensor device.

The remaining two section 76 and 78 of the comparator integrated circuit means 70 are utilized in this failure detector circuit. One of the comparator sections is arranged to provide a free-running square wave oscillator and the other section is arranged to sense the voltage developed across the load resistance and clamp the oscillator to prevent its operation so long as the voltage developed across load resistance 62 exceeds a predetermined minimum value.

To this end, a resistance 122 and a diode 123 are connected across the supply lines 54 and 46 and provide a constant voltage across the diode 123. Resistances 124 and 126 form a voltage divider, the junction point between them being connected to the input terminal 130 of the comparator section 78. The other input terminal 131 of comparator section 78 is connected over conductor 132 with the juntion point 85 to thereby apply the voltage developed across load resistance 62 to terminal 131. The resistances 124 and 126 are selected to provide a 50 mv. reference voltage at the input terminal 130. The value is the lowest safe voltage which should be developed across load resistance 62 if the gas detector and its associated circuitry are in proper condition. Accordingly, when the voltage developed across load resistance 62, which is applied to input terminal 131 of comparator section 78, drops below 50 mv., an output appears at output terminal 140 of comparator section 76. In operation, when the output of comparator section 78 is supplied to the output terminal of comparator section 76, the square wave oscillator provided by comparator section 76 is rendered operative.

As stated, comparator section 76 is arranged to provide a free-running square wave oscillator. Resistances 142 and 144 provide a voltage to the input terminal 146 of comparator section 76 and also through limiting resistance 150 to output terminal 148 thereof. A resistance 151 is provided to limit the voltage on output terminal 148. The combination of a resistance 152 and capacitance 154 provides an R-C network which raises the voltage on input terminal 156 above the reference voltage applied to input terminal 146 causing the comparator section 76 to turn on. Capacitance 154 is discharged through section 76 turning it off while feedback from output terminal 148 through resistance 150 and 152 recharges capacitance 154 turning the comparator section 76 back on. This process is repeated to produce a square wave output.

When output terminal 148 of comparator section 76 receives current from output terminal 136 of comparator section 78, comparator section 76 turns on and off and supplies intermittent current to the base electrode 160 of a transistor switch 162, through a resistance 164 and a diode 166, which causes transistor 162 to be turned on and off. Resistance 164 limits the current to base electrode 160. This on and off switching of transistor 162 produces an intermittent activation of the alarm means 18 which is connected in the emitter-collector circuit of the transistor 162. Since the intermittent warning is different from the continuous warning for indicating the presence of a contaminating gas, it provides for distinctive warning of failure.

From the foregoing description of the principal and operation of the present invention, it will be appreciated that transistor device 92 and its associated relay means 94 may be completely eliminated to provide for a still simpler system if desired. For example, if transistor 92 and relay 94 are not used, transistor 162 may be arranged to control the operation of alarm means 18 for warning of detector failure as well as for warning of the presence of a contaminating gas. This is readily provided by coupling the output of comparator sections 72 and 74 to the base electrode of transistor 162.

Although in accordance with the provisions of the patent statutes, this invention has been described as embodied in concrete form and the principal has been explained together with the best mode in which it is now contemplated applying the principal, it should be understood that the system shown and described is merely illustrative and the invention is not limited thereto since alterations and modifications will readily suggest themselves to persons skilled in the art without departing from the true spirit of the invention or from the scope of the appended claims.

What is claimed as new and desired to be secured by Letters Patent of the United States is:

1. A gas detecting and warning system comprising;

a. A gas detector device of the type comprising a semiconductive body adapted to be thermally activated and exhibiting a resistance characteristic which changes in the presence of a contaminating gas in the ambient environment, said device having a first electrode means arranged for thermally activating said body and a second electrode means operatively associated with said body and spaced from said first electrode means;

b. a direct current source;

c. a load resistance means;

d. means connecting said load resistance means in series circuit relationship with said first and second electrode means and said direct current source operative to produce a current flow through said gas detector device and said load resistance means whereby a decrease in the resistance of the gas detector device which occurs when a contaminating gas is present in the ambient environment results in an increase in the voltage developed across said load resistance means;

e. a source of alternating current of preselected frequency and voltage coupled across the first electrode means of said gas detector device for supplying the power for thermally activating said gas detector device;

f. a quad comparator integrated circuit means having four independent comparator sections, each of which having first and second input means and an output means;

g. Sensing circuit means including a first one of said comparator sections arranged to cause said first comparator section to produce an output whenever the voltage developed across said load resistance means equals or exceeds a preselected value;

h. time delay means including a second one of said comparator sections and a series resistance-capacitance combination arranged to cause said second comparator section to produce an output after said capacitance is charged to a preselected level so that said second comparator section output is produced a predetermined time after energization of the system;

i. a warning alarm means;

j. coincidence means responsive to the outputs of said first and second comparator sections, said coincidence means being also arranged so that the output thereof causes energization of said warning alarm means; and k. failure detecting and warning means operative to cause an intermittent operation of said warning alarm means as a distinctive warning of a failure or malfunction of said gas detector device and/or its associated circuitry, said failure detecting and warning means comprising said third and fourth comparator sections, means arranging said third comparator section for operation as a free running square-wave oscillator, means including said fourth comparator section for inhibiting operation of said square-wave oscillator so long as the voltage developed across said load resistance means exceeds a predetermined value, and means arranging the output of said square-wave oscillator to cause intermittent operation of said warning alarm means.

2. The gas detecting and warning system recited in claim 1 wherein said direct current source is a battery means and said source of alternating current coupled across said first electrode means for supplying the power for thermally activating said gas detector device is an oscillator means coupled to and energized from said battery means and operative to produce an alternating current output of preselected frequency and voltage.

3. The gas detecting and warning system recited in claim 2 wherein the frequency of the output of said oscillator means is above the audio range.

4. The gas detecting and warning system recited in claim 2 wherein said oscillator means produces a sine wave output having a frequency above the audio range.

5. The gas detector and warning system recited in claim 4 wherein said oscillator means comprises a pair of cross-coupled transistor devices and a ferrite core output transformer and the output frequency is 50 khz.

6. The gas detecting and warning system recited in claim 1 including a power transformer means connected with the alternating current supply mains and wherein said direct current source is a rectifier means supplied from one secondary winding of said transformer means and said source of alternating current for supplying the power for thermally activating said gas detector device is provided from another secondary winding of said transformer means.

7. The gas detecting and warning system recited in claim 1 wherein said direct current source is arranged to be selectively provided by a rectifier means supplied from one winding of a power transformer means connected with the alternating current supply mains or a battery means and wherein when said direct current source is provided by said battery means the source of alternating current coupled with the first electrode means and supplying the power for activating said gas detector device is produced by an oscillator means coupled with and energized from said battery means and producing an output of preselected frequency and voltage whereby said system is capable of operation from alternating current supply mains, a battery means, or from alternating current supply mains with battery stand-by power.

8. The gas detecting and warning system recited in claim 1 wherein said sensing circuit means includes an adjustable resistance means applying a preselected reference voltage to one input means of said first comparator section and means applying the voltage developed across said load resistance means to the second input means thereof operative to cause said first comparator section to produce an output at the output means thereof whenever the voltage developed across said load resistance means equals or exceeds said preselected reference voltage.

9. The gas detecting and warning system recited in claim 1 wherein said coincidence means includes a transistor switch means and the outputs of both said first and second comparator sections are required to render said transistor conductive to cause operation of the warning alarm means.

10. The gas detecting and warning system recited in claim 9 wherein said failure detecting and warning means also includes a transistor switch means which is arranged to be turned on and off by the square-wave output of said third comparator section.

11. The gas detecting and warning system recited in claim 1 wherein said coincidence means includes a transistor switch means and the outputs of both said first and second comparator sections are required at the transistor control electrode to render said transistor conductive and cause operation of said alarm means and wherein said system further includes means for coupling the square-wave output of said third comparator section to the control electrode of said transistor and cause intermittent operation of the warning alarm means.

12. A gas detecting and warning system comprising;

a. a gas detector device of the type comprising a metal oxide semiconductor element having a resistance characteristic which changes in the presence of a contaminating gas in the ambient environment;

b. a power supply means connected with said gas detector device, said power supply means producing a first output adapted to supply power to heat said gas detector device to a predetermined operating temperature and a second output adapted to produce a current flow through said gas detector device;

c. a load resistance means connected in series circuit relationship with said gas detector device and the second output of said power supply means so that a decrease in the resistance of said gas detector device which occurs when a contaminating gas is present in the ambient environment results in an increase in the voltage developed across said load resistance means;

d. a quad comparator integrated circuit means comprising four independent comparator sections each having a pair of input terminal means and an output means;

e. means applying a reference voltage to one input terminal means of a first one of said comparator sections and means applying the voltage developed across said load resistance means to the other input terminal means of said first comparator section operative to cause said comparator section to produce an output at the output means thereof whenever the voltage developed across said load resistance means equals or exceeds said reference voltage;

f. a warning alarm means;

g. means including a second one of said comparator sections for inhibiting operation of said alarm means for a predetermined time after the system has been energized, said means comprising means applying a reference voltage to one input terminal means of said second comparator section, means including a series resistance—capacitance combination connected with the other input terminal means of said second comparator section and operative when said capacitance is charged to apply a voltage to said other input terminal means which exceeds said reference voltage applied to said one input terminal means to cause an output to be produced at the output means of said second comparator section, and coincidence means responsive to the presence of outputs from both said first and second comparator sections to effect energization of said warning alarm means; and h. fail-safe failure detecting and warning means operative to effect an intermittent operation of said warning alarm means as a distinctive warning of a failure or malfunction of said gas detector device and/or its associated circuitry, said failure detecting and warning means comprising:

means arranging said third comparator section for operation as a free-running square-wave oscillator; means including said fourth comparator section for inhibiting operation of said square-wave oscillator so long as the voltage developed across said load resistance means exceeds a predetermined value; and means responsive to the output of said square-wave oscillator for causing an intermittent operation of said warning alarm means.

13. The gas detecting and warning system recited in claim 12 wherein said power supply means produced low voltage alternating current power at said first output and direct current at said second output.

14. The gas detecting and warning system recited in claim 13 wherein said power supply means includes a direct current source and an oscillator means energized from said direct current source for producing the low voltage alternating current power at said first output.

15. A gas detecting and warning system comprising:

a. a gas detector device of the type comprising a semiconductive body adapted to be thermally activated and exhibiting when activated the characteristic that the resistivity thereof is substantially reduced when a contaminating gas is present in the ambient environment, said device having a first electrode means operatively associated with said body and arranged for thermally activating said device and a second electrode means operatively associated with said body and spaced from said first electrode means;

b. a pair of power supply lines for said system;

c. a battery connected across said power supply lines for energizing said system;

d. a load resistance;

e. means connecting said load resistance in series with said second electrode means and across said power supply lines to produce a current flow through said device and through said load reistance;

f. an oscillator means coupled to and energized from said battery and being operative to produce an alternating current output having a voltage matching that required for activating said gas detector device;

g. means connecting the output of said oscillator means across said first electrode means to supply the power for thermally activating said gas detector device;

h. a quad comparator integrated circuit means having four independent comparator sections each having first and second input means and an output means;

i. sensing circuit means including;

1. a variable resistance means connected across said system power supply lines and operatively associated with the first input means of a first one of said comparator sections for applying a preselected reference voltage to said first input means; and 2. means applying the voltage developed across said load resistance to the second input means of said first comparator section so that said first comparator section is caused to produce an output whenever the voltage developed across said load resistance equals or exceeds said preselected reference voltage;

j. time delay means including a second one of said comparator sections including;

1. a voltage divider network connected with said system power supply lines and with said first input means for applying a reference voltage to the first input means of said second comparator sections;

2. a capacitance connected to be charged from said power supply lines through a resistance means whereby said capacitance is charged to a predetermined voltage level and above the voltage of said reference voltage a predetermined time after energization of said system; and 3. means coupling the capacitance voltage to the second input means of said second comparator section so that said second comparator section is caused to produce an output a predetermined time after energization of said system;

k. a transistor device having a base electrode, and emitter electrode and a collector electrode;

l. a warning alarm means arranged to be operated when said transistor device is conductive;

m. means coupling the output of said first and second comparator sections to the base electrode of said transistor device, said transistor device being arranged and adapted to be rendered conductive only when the outputs from both said first and said second comparators sections are present;

n. failure detecting and warning means including said third and fourth comparator sections for effecting intermittent operation of said warning alarm means upon failure or malfunction of said gas detector device and/or its associated circuit components, said means comprising;

1. means arranging said third comparator section for operation as a free running square-wave oscillator, said means including a voltage divider network applying a first voltage to the first input means of said third comparator section and means including said voltage divider network and a capacitance applying a second voltage to the second input means and feed-back means coupling the output of said comparator section to said second input means;

2. means coupling the output of said fourth comparator section to the output means of said third comparator section operative to inhibit operation of the square-wave oscillator provided thereby, said fourth comparator section having the voltage developed across said load resistance applied to said first input means and a preselected minimum reference voltage applied to the second input means so that said fourth comparator section produces an output to inhibit operation of the square-wave oscillator so long as the voltage developed across said load resistance equals or exceeds said preselected minimum reference voltage; and 3. means for utilizing the output of said square-wave oscillator to effect an intermittent operation of said warning alarm means.

16. The gas detector and warning system recited in claim 15 wherein the output of said square-wave oscillator is coupled to the base electrode of said transistor device causing said transistor device to be alternatively turned on and off.

17. The gas detector and warning system recited in claim 15 including a second transistor device having base, emitter and collector electrodes, said warning alarm means is arranged to be operated when said second transistor device is conductive and the output of said square-wave oscillator is coupled to said base electrode to alternately render said second transistor conductive and nonconductive.

18. The gas detecting and warning system recited in claim 15 including a relay means and wherein the relay is energized when said transistor device becomes conductive and said warning alarm means is operated through the relay contacts.

19. The gas detecting and warning system recited in claim 18 including a second transistor device having base, emitter and collector electrodes, said warning alarm is arranged to be energized through the collector-emitter circuit, and the output of said square-wave oscillator is coupled to the base electrode to alternately turn said second transistor on and off to cause an intermittent operation of said warning alarm whenever said square-wave oscillator is operative.

* * * * *